US006874261B2

(12) United States Patent
Smit et al.

(10) Patent No.: US 6,874,261 B2
(45) Date of Patent: Apr. 5, 2005

(54) METHOD FOR TREATING AN UNDERWATER BED

(75) Inventors: Paul Smit, Benthuizen (NL); Adrianus Jacobus Petrus Marinus Schuit, Egmond aan Zee (NL)

(73) Assignee: Van Oord N.V., Rotterdam (NL)

( * ) Notice: Subject to any disclaimer, the term of this patent is extended or adjusted under 35 U.S.C. 154(b) by 79 days.

(21) Appl. No.: 08/718,573

(22) PCT Filed: Apr. 7, 1995

(86) PCT No.: PCT/NL95/00129

§ 371 (c)(1),
(2), (4) Date: Oct. 2, 1996

(87) PCT Pub. No.: WO95/27832

PCT Pub. Date: Oct. 19, 1995

(65) Prior Publication Data

US 2003/0056403 A1 Mar. 27, 2003

(30) Foreign Application Priority Data

Apr. 7, 1994 (NL) ..... 9400551

(51) Int. Cl.[7] ..... E02F 3/88; E02F 3/90
(52) U.S. Cl. ..... 37/307; 37/323; 37/335
(58) Field of Search ..... 37/323, 307, 335, 37/344, 334, 322, 336, 342; 405/163, 248

(56) References Cited

U.S. PATENT DOCUMENTS 1,572,472 A * 2/1926 Doren
2,956,354 A * 10/1960 Varner ..... 37/323
3,572,839 A * 3/1971 Okabe ..... 37/195
3,638,439 A * 2/1972 Niederer ..... 405/163 X
3,659,425 A 5/1972 De Geeter
3,877,238 A * 4/1975 Chang et al. ..... 405/163 X
3,885,331 A * 5/1975 Mathieu
4,087,981 A * 5/1978 Norman ..... 405/163 X
4,112,695 A * 9/1978 Chang et al. ..... 405/163
4,114,390 A * 9/1978 Van Steveninck et al. .. 405/163
4,141,159 A * 2/1979 Morris et al. ..... 37/323 X
4,330,225 A * 5/1982 Glasgow ..... 405/163 X
4,479,741 A * 10/1984 Berti et al. ..... 37/323 X
4,497,519 A * 2/1985 Grable ..... 37/323 X
4,840,729 A * 6/1989 Levine
5,155,928 A * 10/1992 Robertson et al. ..... 405/163 X
5,305,585 A * 4/1994 Cousineau ..... 37/344 X
5,360,292 A * 11/1994 Allen et al. ..... 37/323 X
5,435,083 A * 7/1995 Thompson
5,603,171 A * 2/1997 Steinkuhler ..... 37/323 X
6,125,560 A * 10/2000 Beaumont

FOREIGN PATENT DOCUMENTS

EP 0 548 707 4/1996
NL 7 108 106 12/1997

* cited by examiner

*Primary Examiner*—Thomas B. Will
*Assistant Examiner*—Thomas A. Beach
(74) *Attorney, Agent, or Firm*—Young & Thompson

(57) ABSTRACT

A method of forming a trench in the bed of a body of water, the bed having an initial undisturbed upper surface, comprises suspending a pressure line from a vessel floating on the body of water, the pressure line terminating downwardly in a downwardly directed nozzle. The nozzle is positioned a small distance above the bed, and water is pumped under pressure on board the vessel and is discharged via the pressure line and nozzle downwardly against the bed surface with the water pumped at an overpressure between 0.01 bar and 20 bar and at a flow rate of 0.25 to 20.0 cm per second. The distance of the nozzle above the surface of the bed is not more than ten times the diameter of the water jet defined by the nozzle, preferably about six times the diameter of that water jet.

6 Claims, 1 Drawing Sheet

METHOD FOR TREATING AN UNDERWATER BED

The invention relates to a method for treating the bed of a body of water by means of a directed water jet, which water jet is moved over the bed in accordance with an elongated path.

A method of this type is disclosed in WO-A-92/18701. In this known method a pumping installation is used which contains a pump screw which has a relatively large diameter. Using this pumping installation, a relatively large amount of water can be discharged at relatively low speed, in such a way that a trench is made in the bed when the pumping installation is dragged over the bed.

The pumping installation is provided with positioning means with which it has to be held at a certain distance above the bed. By means of tow cables, it is moved forwards by a vessel, for example an ocean-going tug, which also contains the power source for driving the pump screw.

The known method and installation have the disadvantage that the dredging process is difficult to control. The pumping installation must be held under water in the correct position with respect to the bed, which can have associated complications.

The aim of the invention is, therefore, to provide a method of the type described above which does not have these disadvantages. This is achieved in that water in pumped under pressure on board a vessel and is then discharged, via a pressure line connected to said vessel, a small distance above, and directed towards, the bed.

With the method according to the invention, virtually any equipment, in particular that for generating the water jet, can be installed on board the vessel itself. This means that that part of the installation which remains underwater can remain relatively simple, which is beneficial for the reliability and also results in lower costs.

The water can be pumped at an overpressure between 0.01 bar and 20 bar, preferably at an overpressure between 0.01 bar and 8 bar. Depending on the distance of the spray nozzle of the pressure line to the bed to be treated, various results can be obtained by means of such pressures. In any case however, the distance of the nozzle to the bed is equal to maximally 10 times the diameter of the water jet defined by the nozzle or the envelope of several jets defined by the nozzle. Preferably, said distance to the bed is equal to 6 times the diameter of the water jet defined by the nozzle or of the envlope of several jets defined by the nozzle.

In case a relatively large distance of the nozzle to the bed is selected, the phenomenon of entrainment of surrounding water by the water jet occurs. Thereby, a water flow having a lower speed is generated, but the flow rate and the transverse dimension of said water flow have become greater.

Over a distance of about 6 times the diameter of the water jet defined by the nozzle, neither the impulse nor the energy of the water flow thus generated diminishes significantly. Such water flow is very suitable for jetting a trench in the bed. The flow is deflected away transversely, leading to transport of bed material and to deposing of such material at both sides of the shallow trench thus formed.

Thus, according to a first possibility, it is possible to form a trench in the bed of the body of water using the method according to the invention. In this case, the pressure and the flow rate of the water jet must be chosen sufficiently high that the bed material is completely fluidised and sprayed away.

In case the distance towards the bed is smaller, no such wide water flow can occur. As a result, the water jet delivered by the nozzle hits the bed in concentrated shape, leading to penetration of water into the bed. Thereby, the coherence of the soil mixture is broken, and "dilution" occurs. In this process, water is fed into the particle skeleton, as a result of which the bed material acquires liquid-like properties.

According to this possibility, the water in fed into the bed material in such a way that the particle skeleton thereof partially loses its cohesion and/or strength (dilution). In this case, complete fluidisation does not occur and the bed material retains a certain cohesion and/or strength. This variant of the method according to the invention can be used when burying a cable or pipeline laid in or on the bed. In this case, the pressure and the flow rate of the water jet are so chosen that the cohesion and/or strength of the particle skeleton of the bed material is reduced down to such a depth that the pipeline or cable sinks into the bed under the influence of its own weight.

Depending on the bed material, a cable or pipeline to be buried can also be laid sometime after dilution of the bed material. The interval between the treatment of the bed material and laying of a cable or pipeline depends on the consolidation time of the bed material. In the case of another similar variant, it is possible to remove the buried article from the bed with the exertion of little force by diluting the bed material to an appropriate degree in the vicinity of the bottom of, for example, a cable, pipeline or other buried article.

Good results can be obtained if the flow rate of the jet is 0.25 to 20.0, in particular 0.25 to 5.0, cubic meters per second.

A vessel for carrying out the method described above has a pressure line which has a spray nozzle, as well as means for holding the pressure line against the force of reaction of the water jet discharged from the spray nozzle.

By means of a pressure line of this type it is possible to discharge a water jet under a considerable impulse, in such a way that a broad and deep trench can be formed in the bed by spraying.

In order to be able to hold the spray nozzle in the correct position, ballast means can also be provided. As an alternative, however, it is also possible to provide dynamic positioning means for holding the pressure line in position.

Various types of vessel can be chosen for the vessel to be used with the method. These vessels can be specially developed vessels; advantageously, however, a hopper suction dredger can be used, comprising a well in addition to at least one line which can be played out down to the bed of a body of water, pressure means being provided which are connected to the end of the line which is connected to the vessel.

In the case of the method according to the invention, the hopper suction dredger is not used to exert a suction effect but to exert a spray effect.

As is known, a hopper suction dredger of this type comprises suction means for drawing up bed material under suction via the line. According to the invention, switching means are now provided for connecting the pressure means or the suction means to the line, as desired.

Using a hopper suction dredger of this design, it is possible both to use the method according to the invention and to carry out the normal suction operation.

The nozzle can have a diameter 0.1 to 5.0 meters, preferably 0.2 to 1.0 meter, in size.

In connection with the burying of a pipeline or cable which has already been laid, the end of the nozzle can terminate in a multiplicity of smaller nozzles, which are of rectangular shape and the individual cross-sectional surface area of which is from 0.005 to 1.0 $m^2$ in size. The small nozzles can also have a circular shape, in which case the diameter of the individual nozzles is from 0.1 to 1.0 meter in size. Using a nozzle of this type, the water jet can be metered easily over, for example, the circumference of the pipeline or cable.

An example of a vessel for carrying out the method according to the invention will be described in sore detail below with reference to the figures.

The vessel, which is indicated in its entirety by 1, is constructed as a hopper suction dredger, which is provided with a line 2. A nozzle 3 is fitted at the end of the line 2,: the line 2 itself can be paid out in an known manner, by means of cables 4 and 4', to just above the bed 5 of a body of water.

Pumping means for pumping water via the line 2 to nozzle 3 are installed on board the hopper suction dredger in a manner which is not shown in sore detail.

Figure 1:
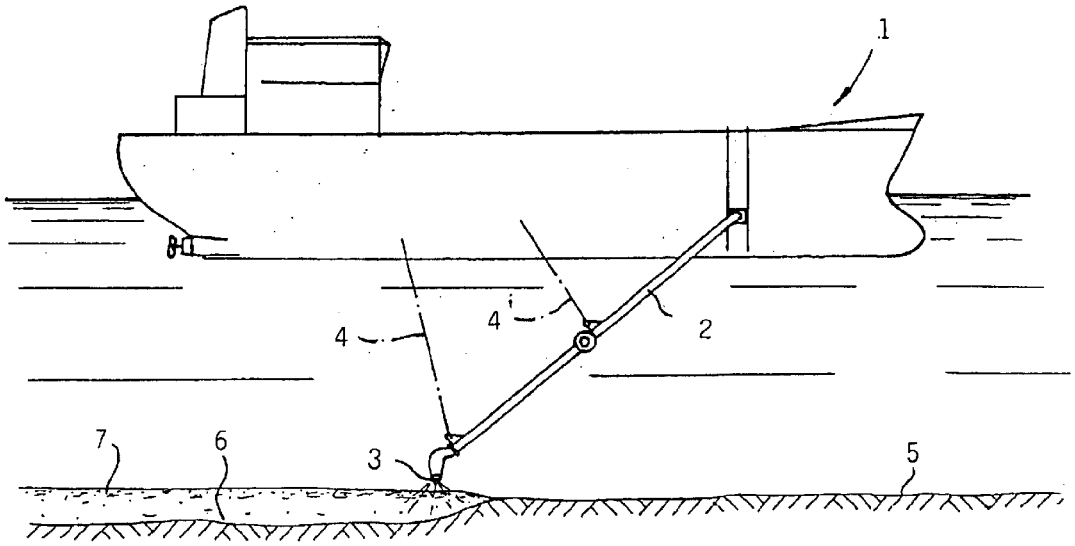
FIG. 1 shows a side view of a vessel of this type.
Figure 2:
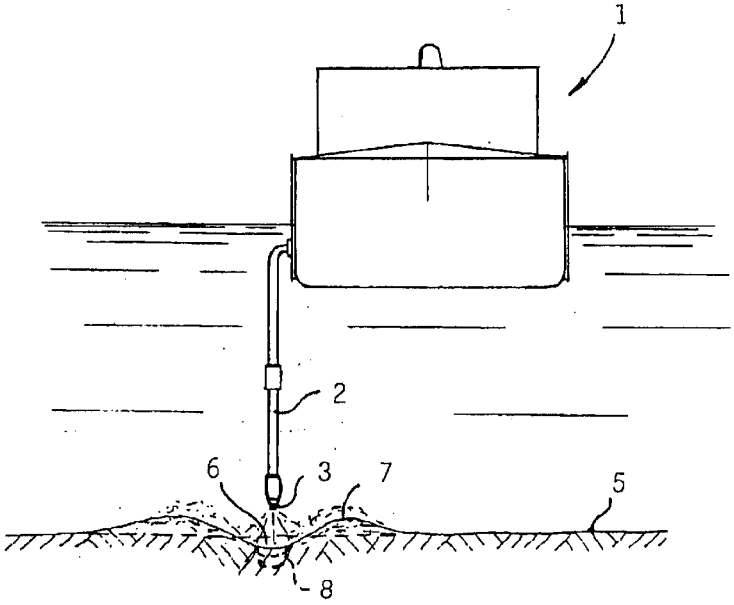
FIG. 2 shows a front view.

As the vessel 1 sails, a trench 6 is flushed out in the bed by the discharge of a water jet from the nozzle 3. The bed material which is sprayed away partly collects in the banking 7 alongside the trench 6. With this procedure, the bottom of the trench can be diluted. The area of the bed material which is diluted is indicated by 8 in FIG. 2. The cohesion and/or strength is partly retained, but has become so low that a pipeline or cable which has already been laid is able to sink into the bed.

Ballast means or dynamic positioning means (which incidentally are not shown), can be provided in the vicinity of the nozzle 3 to hold the line 2 in place against the force of reaction of the water jet 3.

What is claimed is:

1. A method of forming a trench in the bed of a body of water, said bed having an initial undisturbed upper surface, comprising suspending a pressure line from a vessel floating on said body of water, said pressure line terminating downwardly in a downwardly directed nozzle, positioning said nozzle a distance above said bed, pumping water under pressure on board said vessel and discharging said water via said pressure line and said nozzle downwardly against said surface with said water pumped at an overpressure between 0.01 bar and 20 bar and at a flow rate of 0.25 to 20.0 cm per second, while maintaining said nozzle positioned at said distance above said bed.

2. A method as claimed in claim 1, wherein said distance is not more than ten times the diameter of the water jet defined by said nozzle.

3. A method as claimed in claim 1, wherein said distance is about six times the diameter of the water jet defined by said nozzle.

4. A method as claimed in claim 1, wherein the water is pumped at an overpressure between 0.01 bar and 8 bar.

5. A method as claimed in claim 1, wherein said nozzle has an internal diameter of 0.1 to 5 meters in size.

6. A vessel as claimed in claim 1, wherein said nozzle has an internal diameter of 0.2 to 3.0 meters in size.

* * * * *